US006428094B1

(12) United States Patent
Ruiter

(10) Patent No.: US 6,428,094 B1
(45) Date of Patent: Aug. 6, 2002

(54) ADJUSTABLE FURNITURE UNIT

(75) Inventor: Joey Ruiter, Grand Haven, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/640,195

(22) Filed: Aug. 16, 2000

(51) Int. Cl.[7] ..... A47B 85/04

(52) U.S. Cl. ..... 297/119; 297/124; 297/125; 297/283.1

(58) Field of Search ..... 297/119, 124, 297/125, 283.1, 283.2, 283.3

(56) References Cited

U.S. PATENT DOCUMENTS

| | | | | | |
|---|---|---|---|---|---|
| 433,795 | A | * | 8/1890 | Knoeller | 297/125 X |
| 1,218,322 | A | * | 3/1917 | Sandell | 297/125 X |
| 1,222,673 | A | | 4/1917 | Rizzo | |
| 1,299,881 | A | | 4/1919 | Walter | |
| 1,425,354 | A | | 8/1922 | Worthington | |
| 1,773,501 | A | | 8/1930 | Scholnhammer | |
| 2,433,699 | A | | 12/1947 | Keen | |
| 2,516,498 | A | | 7/1950 | Womock, Jr. | |
| 2,584,642 | A | | 2/1952 | Tuttle | |
| 2,625,984 | A | | 1/1953 | Schweikert | |
| 2,628,879 | A | | 2/1953 | Schultz | |
| 2,749,971 | A | | 5/1956 | Ehrman | |
| D178,611 | S | | 8/1956 | Mickelson | |
| 3,025,101 | A | | 3/1962 | McKinnie | |
| 3,233,942 | A | | 2/1966 | Creutz | |
| 3,290,090 | A | | 12/1966 | Ford | |
| 3,350,133 | A | | 10/1967 | Schaefer | |
| 3,420,571 | A | * | 1/1969 | Moore | 297/124 |
| 3,960,241 | A | | 6/1976 | Arias | |
| 4,447,087 | A | | 5/1984 | Massonnet | |
| 4,645,261 | A | | 2/1987 | Bourne et al. | |
| 5,292,172 | A | | 3/1994 | Watts et al. | |
| 5,507,549 | A | | 4/1996 | Cope | |
| 5,609,391 | A | | 3/1997 | Watts et al. | |
| 5,647,632 | A | | 7/1997 | Fireman | |
| 5,882,069 | A | | 3/1999 | Gunnett et al. | |

FOREIGN PATENT DOCUMENTS

| | | | | |
|---|---|---|---|---|
| DE | 239578 | * | 4/1911 | 297/119 |
| DE | 289754 | * | 4/1914 | 297/119 |
| GB | 1190221 | * | 4/1970 | 297/124 |

* cited by examiner

*Primary Examiner*—Laurie K. Cranmer
(74) *Attorney, Agent, or Firm*—Price Heneveld Cooper Dewitt & Litton

(57) ABSTRACT

A furniture unit includes a base, a horizontal panel having front and rear edges, and a vertical panel having upper and lower edges. A support is provided with a center pivot connected to the base, a front pivot connected to a front edge of the horizontal panel, and a rear pivot connected to a lower edge of the vertical panel. The support is movable to a first position where a front surface of the vertical panel is located generally rearwardly of and above the rear edge, and is movable to a second position where the vertical panel is located generally rearwardly of and below the rear edge. The support moves the vertical and horizontal panels with a counterbalanced motion. In one form, the arrangement forms an adjustable sit/stand chair. In another form, the arrangement forms a desk with a height-adjustable work-surface and adjustable-height backboard. Notably, the back-board can be a functional panel, and may include an erasable surface, a grooved surface for supporting accessories, or a tackable surface. In yet another form, a furniture unit is configured for adjustment between a chair configuration and a desk configuration.

27 Claims, 4 Drawing Sheets

ADJUSTABLE FURNITURE UNIT

BACKGROUND OF THE INVENTION

The present invention relates to adjustable furniture units, and in particular to furniture units that are adjustable to meet the different and changing needs of a user.

Recently, consumers and furniture manufacturers have recognized the value of having furniture optimized for ergonomics and efficiency, given particular tasks that must be done. Such furniture leads to healthier and happier employees, as well as safer and more efficient work areas. However, the problem is complicated when the user's needs change substantially, such as when a person needs to sit at a desk/worksurface for a time, and then later needs to stand in a semi-upright position such as for leading a meeting or for doing a different type of work. One way to do this is to make the furniture unit highly adjustable. However, it is often difficult to design one furniture unit optimized for each of several different tasks when the tasks are totally different. For example, it is not easy to provide adult furniture suitable and sturdy enough for office use that is functional for both sitting and standing. Further it is important not to make the furniture unit so complex that it becomes impractical or so expensive to build that it is unaffordable. Also, the mechanism permitting such reconfiguration or adjustment is often not intuitive to operate, such that users unnecessarily struggle to make a reconfiguration or adjustment.

Another issue concerns the different functions that an adjustable furniture unit is designed to satisfy. It is desirable to design a basic mechanism capable of satisfying different needs, including the need for seating units capable of adjusting between a sitting position and a standing "stool" position, and including the need for working furniture capable of adjusting between different seating and desking arrangements. Further, it is desirable that the basic mechanism be relatively easy to operate and potentially counterbalanced so that it will not drop with a substantial force during an adjustment if the person adjusting it inadvertently mishandles or lets go of the furniture unit.

Accordingly, a furniture unit is desired having the aforementioned advantages and solving the aforementioned problems.

SUMMARY OF THE PRESENT INVENTION

In one aspect of the present invention, a furniture unit includes a base, a horizontal panel member having front and rear edges, and a vertical panel member having upper and lower edges. A support is provided with first, second, and third pivots spaced from each other, the first pivot being connected to the base, the second pivot being connected to the horizontal panel proximate the front edge, and the third pivot being connected to the vertical panel member proximate the lower edge. The support is movable to a first position where a front surface of the vertical panel member is located generally rearwardly of and above the rear edge, and is movable to a second position where the vertical panel member is located generally rearwardly of and below the rear edge.

In another aspect of the present invention, a furniture unit includes a base, a first panel member extending generally horizontally, and a second panel member extending generally vertically. An adjustment mechanism operably connects the first and second panel members to the base for movement between a first configuration where a substantial portion of said second panel member is above and generally behind the first panel member, and in a second configuration with a substantial portion of said second member being below and generally behind the first panel member. The first panel member is positioned in a higher vertical location when in the second configuration than in the first configuration.

In another aspect of the present invention, a furniture unit includes a base, and an adjustable subassembly including first, second, and third structural members operably interconnected to each other in a serial arrangement. The adjustable subassembly is operably supported on the base for movement between a first position forming one of a low chair and a low desk, and a second position forming one of a stool and a high desk.

In still another aspect of the present invention, a furniture unit includes a base, first and second panels supported on the base, and an adjustable support pivoted to the base and operably connected to the first and second panels. The adjustable support, when in a first position, locates a front surface of the second panel above and generally perpendicular to the first panel so that the second panel is usable and accessible while a person is simultaneously also using a top surface of the first panel, and when in a second position, locates the front surface of the second panel below a rear edge of the first panel so that the second panel is stored and the front surface is substantially not accessible over the top surface of the first panel.

In still another aspect of the present invention, a furniture unit includes a base, an elongated support pivoted to the base, and a first panel member pivoted to the support and operably supported on the base. The first panel member is movable between a lowered position here the first panel member extends generally horizontally and is juxtaposed abuttiningly adjacent the support, and a raised position where the first panel member extends generally horizontally and is positioned at an angle to the support.

In still another aspect, a furniture unit includes a desking unit having a worksurface with a rear edge, a support operably connected to the desking unit, and a rear vertical panel also supported by the support for counterbalanced movement between a raised position where at least an upper portion of the vertical panel extends above the rear edge to act as a visual separator, and a lower position where the vertical panel extends below the rear edge to form a modesty panel.

In yet another aspect, an arrangement comprises, in combination, an adjustable seating unit and an adjustable furniture unit. The seating unit is adjustable to a chair position for use as a chair, and adjustable to a stool position for use while substantially standing but while partially resting on the seating unit. The adjustable furniture unit includes a vertically adjustable worksurface adapted to support papers at a desk height for use while sitting, and at an elevated table height for use while standing or resting on a stool. The seating unit and the adjustable furniture unit, when in the chair position and at the desk height, are usable as an individual's office, and when in the stool position and at the elevated-table height, are usable for conferencing around a table with raised seating.

These and other features, objects, and advantages of the present invention will become apparent to a person of ordinary skill upon reading the following description and claims together with reference to the accompanying drawings.

DETAILED DESCRIPTION OF THE PREFERRED EMBODIMENT

Figure 2:
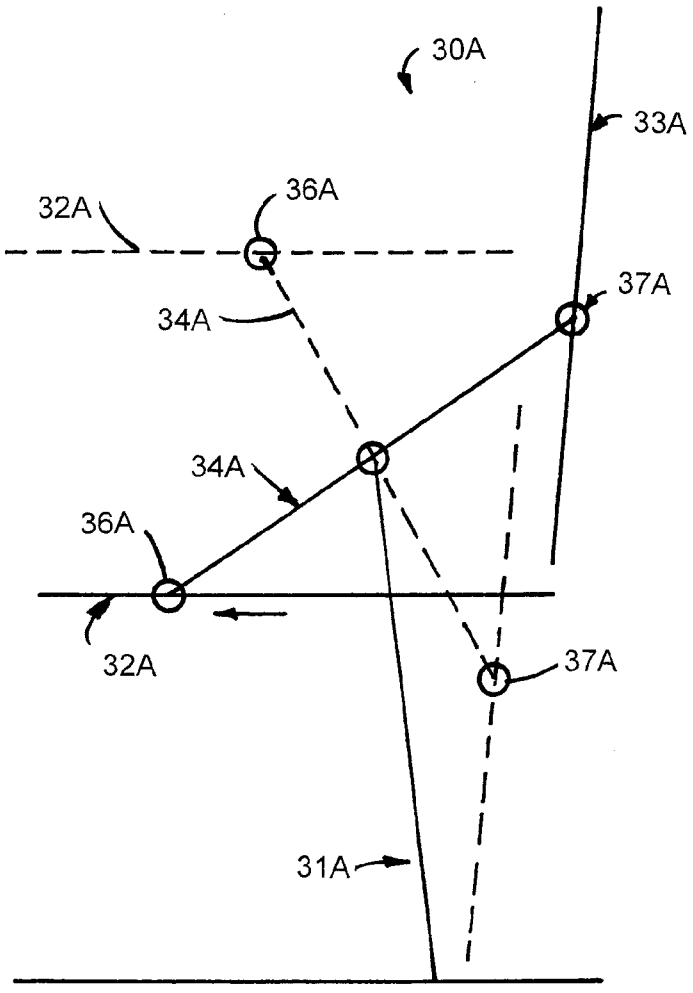
FIG. 2 is a side schematic view similar to FIG. 1, but with the support member elongated such that the first position is the same as in FIG. 1, but so that the second position is significantly different.

A furniture unit 30 (FIG. 1) schematically shows a basic adjustment mechanism comprising a base 31, a horizontal panel member 32, a vertical panel member 33, and an adjustable support 34 for the panel members 32 and 33. The support 34 is provided with a center pivot 35 connected to the base 31, a front pivot 36 connected to a front edge of the horizontal panel member 32, and a rear pivot 37 connected to a lower edge of the vertical panel member 33. The horizontal panel member 32, the support 34 and the vertical panel member 33 are structural and are interconnected in series to form an adjustable subassembly on the base 31. Specifically, the support 34 is movable to a first position (see the solid lines) where the horizontal panel member 32 is lowered and a front surface of the vertical panel member 33 is located generally rearwardly of and above the rear edge of the horizontal panel member 32. The support 34 is further movable to a second position (see the dashed lines) where the horizontal panel member 32 is raised up, and the vertical panel member 33 is located generally rearwardly of and below the rear edge of the horizontal panel member 32. In one form, the arrangement forms an adjustable "sit/stand" chair (see FIG. 1, FIG. 2, FIGS. 3–10, FIGS. 11–12, FIGS. 13–14 and FIGS. 15–16). In another form, a furniture unit is configured for adjustment between a chair-like first position and a desk-like second position (see FIG. 1, FIG. 2, and also note FIGS. 3–10). In yet another form, the arrangement forms a desk with a height-adjustable worksurface and a height-adjustable accessory-supporting back panel (see FIG. 1, FIG. 2, and FIGS. 15–16). Notably, the back panel can include a tackable surface, an erasable writing surface, or a grooved surface for supporting accessories, or it can simply be a height-adjustable workspace-defining screen that provides visual separation between office areas.

Furniture unit 30 (FIG. 1) is adjustable between its first position (see the solid lines) and the second position (see the dashed lines) by rotating the support 34 about center pivot 35. It is contemplated that latches or locks (not specifically shown in FIG. 1) will be located at each pivot 35–37 for holding the members 32–34 in a selected adjusted position. Alternatively, locking arms (not shown in FIG. 1, but known in the art) (see FIGS. 7, 10, and 11) can be extended between members 32–34 to form triangular structural arrangements that lockingly/releasably secure the members 32–34 at selected positions. For example, a releasable locking-type pneumatic cylinder, when used as a locking arm, can be released to allow adjustment and also can be locked to hold the members 32–34 in a selected position. Alternatively, the panel members 32–33 can be interconnected by a cable or other means for providing a coordinated synchronous motion as the support 34 is rotated between positions. Alternatively, the latches or locks can be independently and infinitely adjustable and lockable, such that the support 34 can be secured in any adjusted position between the two illustrated positions, thus allowing the panel members 32 and 33 to be secured in any angularly adjusted position. It is noted that the basic adjustment mechanism places the panel members 32 and 33 at positions on the support 34 so that the weight of panel members 32 and 33 counterbalances each other during adjustment. This counterbalancing makes it easier for a person to make the adjustment, and further reduces the need to use massive and heavy duty latches or locks to hold the panel members 32 and 33 in adjusted positions. Further, it is noted that when a person sits on the horizontal member 32 when the furniture unit 30 is in the first position (i.e. see the solid lines, where the horizontal panel member 32 is positioned at a lowest position), a weight of the seated person holds the panel members 32 (and also 33) in their first position. Similarly, when a person sits on the horizontal panel member 32 when it is in a raised position, the weight of a seated person presses a rear edge of the horizontal panel member 32 downwardly against a top edge of the vertical panel member 33. The latch or lock at the connection can be made with a downwardly oriented structure so that this weight assists in holding the rear edge and top edge together.

Several additional embodiments are shown in the FIG. 2, FIGS. 3–10, FIGS. 11–12, FIGS. 13–14, and 15–16. In these figures, the members 30–37 that are similar or identical are identified by the same identifier numbers, but with the addition of a letter "A" or "B", etc. This is done to reduce redundant discussion, and to better teach the present invention, and not for any other purpose.

Figure 1:
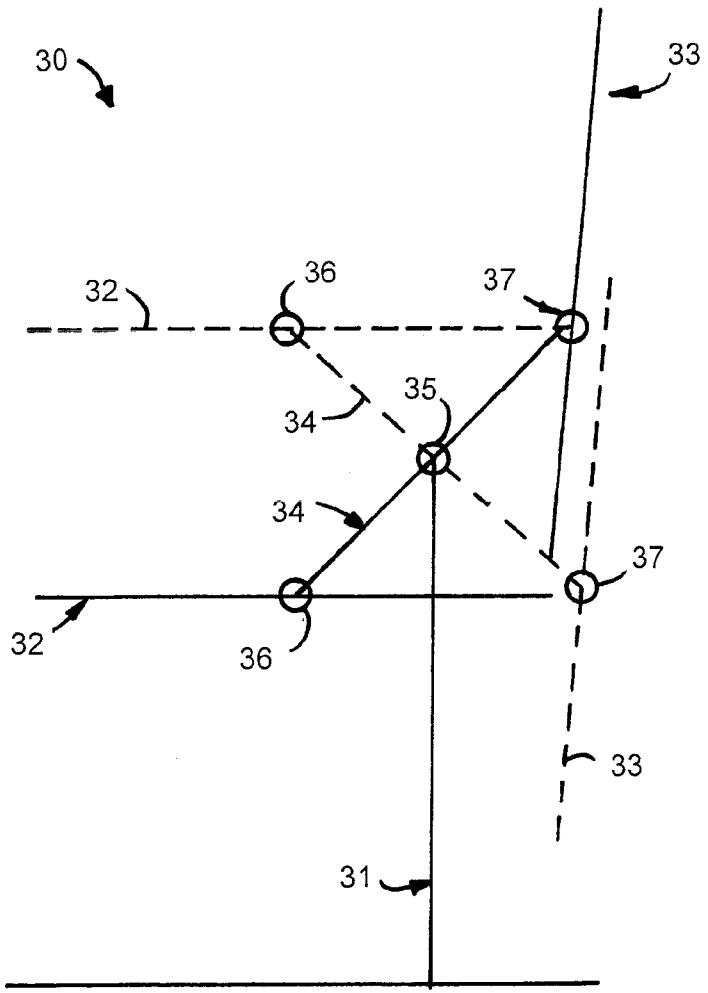
FIG. 1 is a side schematic view of a furniture unit incorporating a basic mechanism of the present invention, the solid lines showing a first position and the dashed lines showing a second position.
Figures 3, 4, 5, 6, 7, 8, 9, 10:
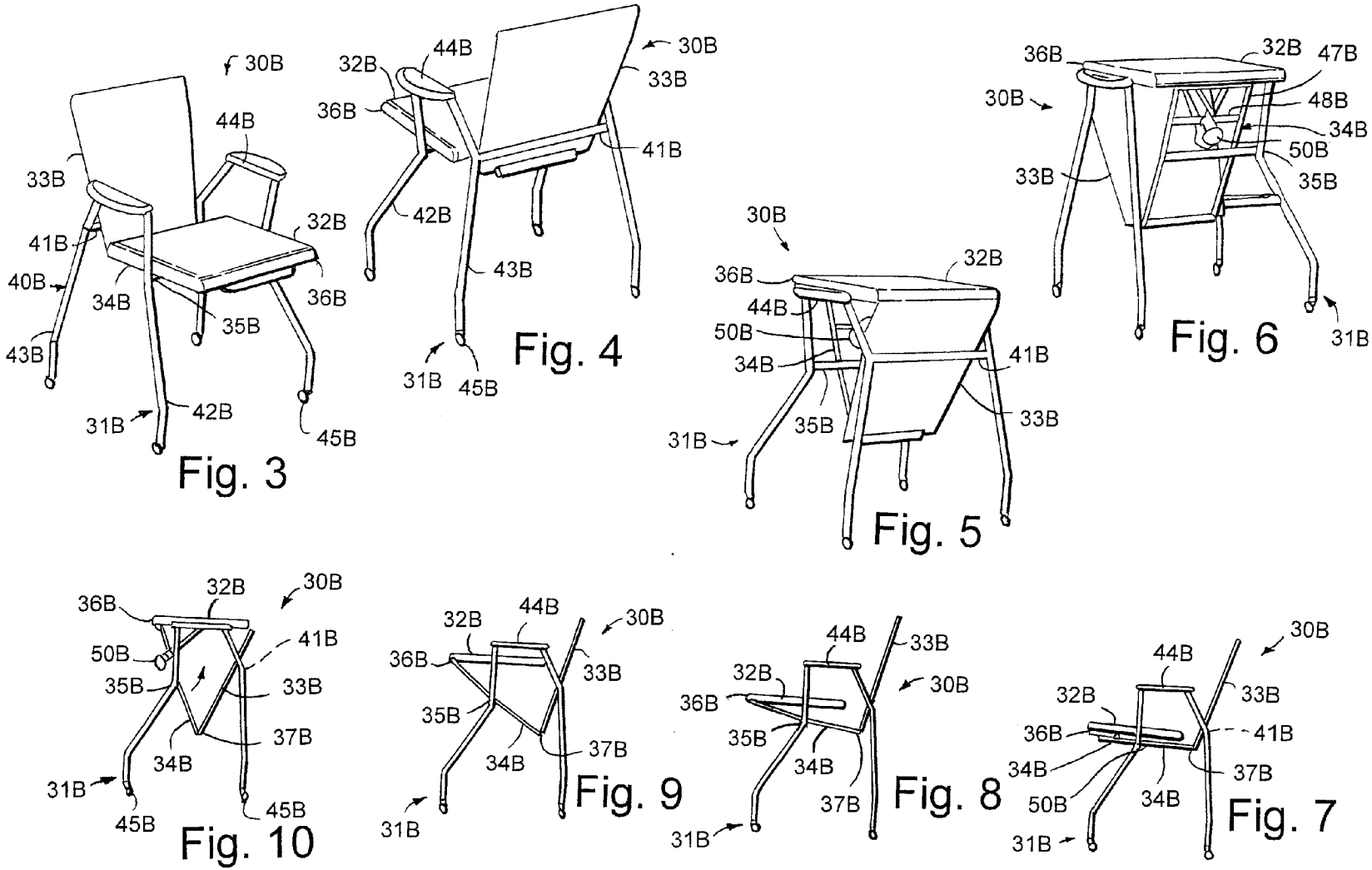
FIGS. 3–4 are perspective views of an adjustable chair incorporating the basic mechanism of FIG. 1 the chair being adjusted to the first position.
FIGS. 5–6 are perspective views of the chair of FIG. 3, but adjusted to the second position to form a stool like arrangement.
FIGS. 7–10 are side views showing the chair of FIGS. 3–6 as it is adjusted from the chair-like first position of FIGS. 3–4 to the stool-like second position of FIGS. 5–6.
Figure 11:
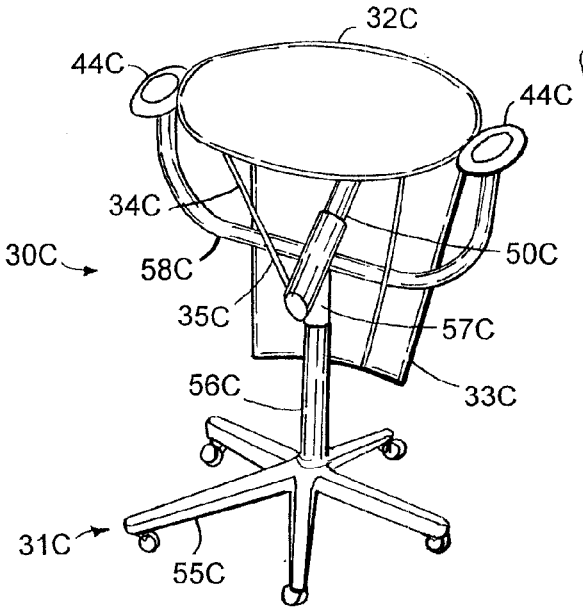
FIGS. 11–12 are side views of a modified chair that is similar to the chair of FIGS. 3–6, but that incorporates modified structural members, the chair in FIG. 11 being in the first position and the chair in FIG. 12 being in the second position.
Figure 12:
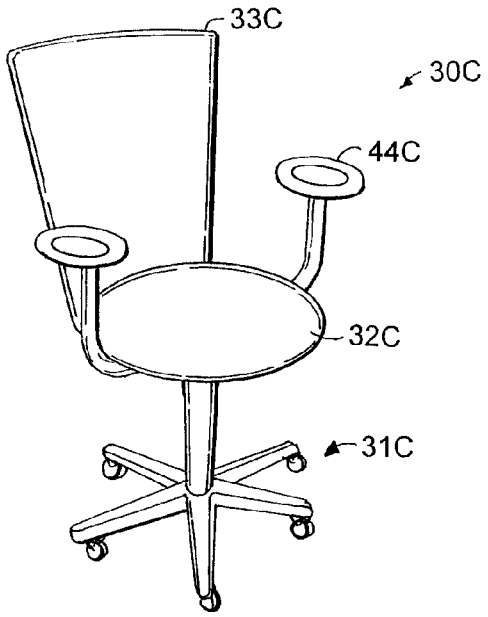
Figure 13:
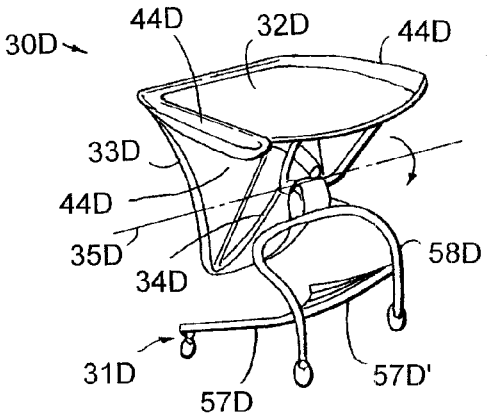
FIGS. 13–14 are side views of a second modified chair that is similar to the chair of FIGS. 3–6, but that incorporates second modified structural members, the chair in FIG. 13 being in the first position and the chair in FIG. 14 being in the second position.
Figure 14:
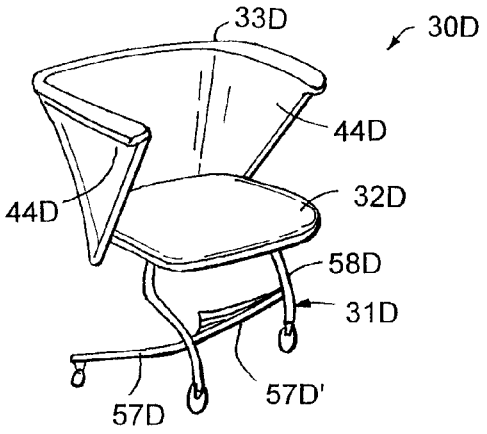

The furniture unit 30A (FIG. 2) includes a base 31A, a horizontal panel member 32A, a vertical panel member 33A and an adjustable support 34A. The support 34A is pivoted at center pivot 35A, and is pivoted at front pivot 36A to the horizontal panel member 32A at one end, and is pivoted at rear pivot 37A to the vertical panel member 33A at its other end. The support 34A of furniture unit 30A is longer than the support 34 on the furniture unit 30, such that the front and rear pivots 36A and 37A are spaced farther from the center pivot 35A. This results in the center pivot 35A and the front pivot 36A of the furniture unit 30A being moved forward from the "back" panel member 33A, relative to the positions of the center pivot 35 and the front pivot 36 of furniture unit 30 to its "back" panel member 33. As can be seen by comparing FIG. 1 and FIG. 2, the relative positions of the horizontal and vertical panel members 32 and 33 (FIG. 1)

and also of the horizontal and vertical panel members 32A and 33A (FIG. 2) are identical when in the first adjusted position (see the solid lines in both FIGS. 1–2). However, when adjusted to the second position (see the dashed lines), the horizontal panel member 32A (FIG. 2) is much higher than the horizontal panel member 32 (FIG. 1). Also, when adjusted to the second position (see the dashed lines), the vertical panel member 33A (FIG. 2) is much lower than the vertical panel member 33 (FIG. 1). This illustrates the power of the present inventive construction. Specifically, it is contemplated that a wide range of possibilities are made possible by adjusting lengths and relative pivot points of this basic mechanism. It is contemplated that a person of ordinary skill in the art will begin to realize the usefulness and flexibility of the present arrangement by comparing FIGS. 1–2.

Furniture unit 30B (FIG. 10) includes a base 31B with side frame sections 40B connected by at least one transverse member 41B and the support 34B. The side frame sections 40B each have an inverted U shape, and include front and rear tubular legs 42B and 43B connected at their top ends by an armrest 44B. The rear legs 43B are connected by the transverse member 41B. The front legs 42B are connected by the support 34B, which both rigidly interconnects the front legs 42B and also pivotally supports the support 34B at center pivot 35B. The illustrated members 41B–44B are tubular, although it is contemplated that other constructions can be substituted. Castors 45B are attached to a bottom of each leg 42B and 43B. The transverse member 41B is located at a height where it engages and supports the back-forming panel member 33B when the back-forming panel member 33B is in its upright raised position. The support 34B includes tubular side members 47B (FIG. 6) and transverse braces 48B that form a rigid ladder-like structure.

A latch arm 50B (FIG. 10) includes a first end pivotally attached to a center of the horizontal panel member 32B, and includes a second end attached to a transverse brace 48B on the support 34B at a location spaced from both pivots 36B and 37B. Also, the rear edge of the horizontal panel member 32B engages a top edge of the vertical panel member 33B for increased stability. As illustrated, the furniture unit 30B is in a stool position. One of the ends 51B and 52B is releasable and when released, the support 34B is pivoted, resulting in movement of the horizontal and vertical panel members 32B and 33B as illustrated. In the final adjusted chair-forming position shown in FIG. 7, the latch arm 50B engages a second transverse brace 48B to hold the furniture unit 30B in a stable position. A handle can be formed on one of the ends of latch arm 50B to provide improved aesthetics and to provide improved intuitive use of the release mechanism. It is contemplated that the release mechanism for the latching arm will be operably connected to the handle.

In one contemplated alternative, the latch arm 50B is replaced with a pneumatic cylinder having a release button. For example, where the pneumatic cylinder was compressed in the chair-forming position (see FIG. 7), it would assist in moving the panel members 32B and 33B from the chair position (FIG. 7) to the stool-forming position (FIG. 10) when its release button was depressed and its extendable rod extended.

It is noted that several suitable release mechanisms are known in the art, such that a detailed description is not believed to be necessary for an understanding by a person skilled in the art. Nonetheless, a scope of the present inventive concepts is believed to include such various release mechanisms.

Furniture unit 30C (FIGS. 11–12) includes a base 31C having a castored, spider-legged bottom 55C with a hub 56C, and a telescopingly extendable post 57C with pneumatic lift-assist cylinder extending upwardly from the hub 56C within the post 57C. An upper frame 58C includes a U-shaped frame member with a horizontal center section and upturned end sections, and armrests 44C are supported on the upturned end sections.. The support 34C includes a pair of rods pivoted to the upper frame 58C, each having opposing ends pivoted to the horizontal and vertical panel members 32C and 33C. The horizontal panel member 32C is cushioned and forms a seat member, and the vertical panel member 33C is made of a flexible resilient plastic panel useful for supporting a person's upper torso when the person is seated. The latching arm 50C is pivotally connected to and extends from a top of the extendable post 57C. The latching arm 50C includes a rear end adapted to securely engage a rear edge of the seat member 32C and to securely engage a top edge of the back member 33C (see FIG. 11), when the furniture unit 30C is min a seat-forming position. The rear end of the latching arm 50C is further adapted to securely engage a rear edge of the seat member 32C and to securely engage a bottom edge of the back member 33C (see FIG. 12) when the furniture unit 30C is in a stool-forming position.

Furniture unit 30D (FIGS. 13–14) is not unlike the furniture unit 30B (FIGS. 7–10). However, in furniture unit 30D (FIGS. 13–14), the vertical panel member 33D incorporates triangularly-shaped armrests 44D along its side edges. By this arrangement, the vertical panel member 33D becomes concavely shaped (in top view) for receiving the seat member 32D. In the stool-forming position, a top surface of the horizontal panel member 32D is flush with the top edge of the panel member 33D, thus forming an enlarged top surface. In the chair-forming position, the top surface of the horizontal panel member 32D is enclosed on three sides by the vertical panel member 33D, thus forming a comfortable enclosed seat construction.

The furniture unit 30D also includes a modified base 31D. The base 31D includes an inverted U-shaped rear frame member 57D forming two rear legs, and an inverted U-shaped front frame member 58D forming two front legs. The front and rear frame members 57D and 58D are welded together, with the rear frame member 57D being relatively more horizontal and the front frame member 58D being relatively more vertical. This results in a base 31D that has an open pocket in a rearward direction, creating a cantilevered effect. Also, the cross piece 57D' of the rear frame member 57D extends at a convenient height for a foot rest, such as for receiving a person's feet while sitting on the furniture unit 30D. The center pivot 35D is formed at a center and top of the front frame member 58D. The illustrated support 34D is H-shaped, although it is contemplated that differently shaped supports could also be used.

Figure 16:
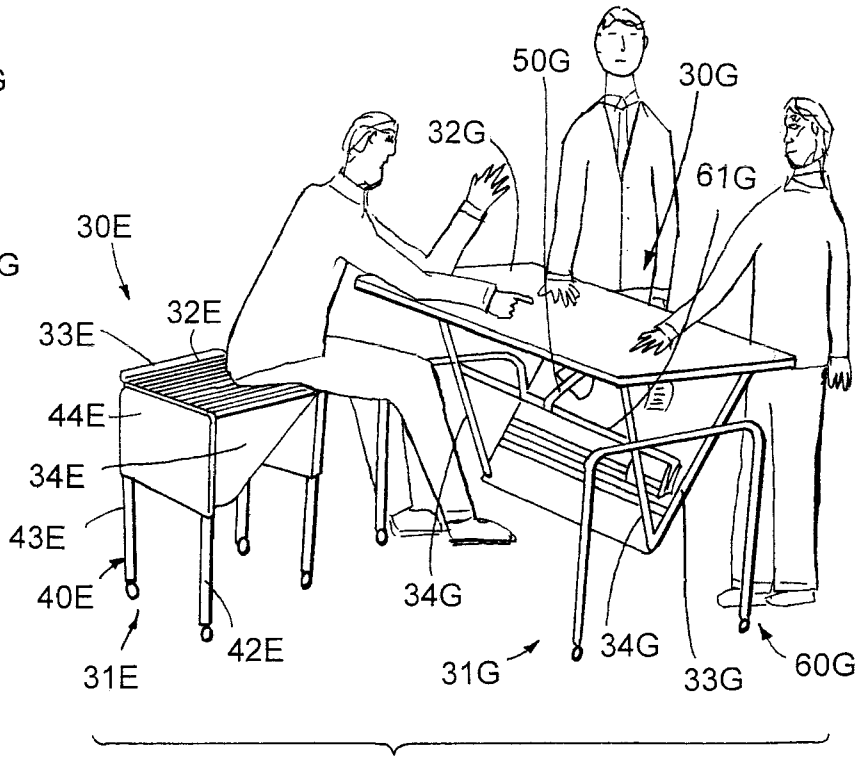
FIGS. 15–16 are perspective views of an office arrangement incorporating an adjustable-height chair and an adjustable-height desking arrangement, where the two furniture units (i.e. the chair and the desk) cooperate to provide a single set of furniture adapted for use by a single person in an individual workspace (see FIG. 15) and when adjusted, adapted for multi-person conferencing (see FIG. 16).
Figure 15:
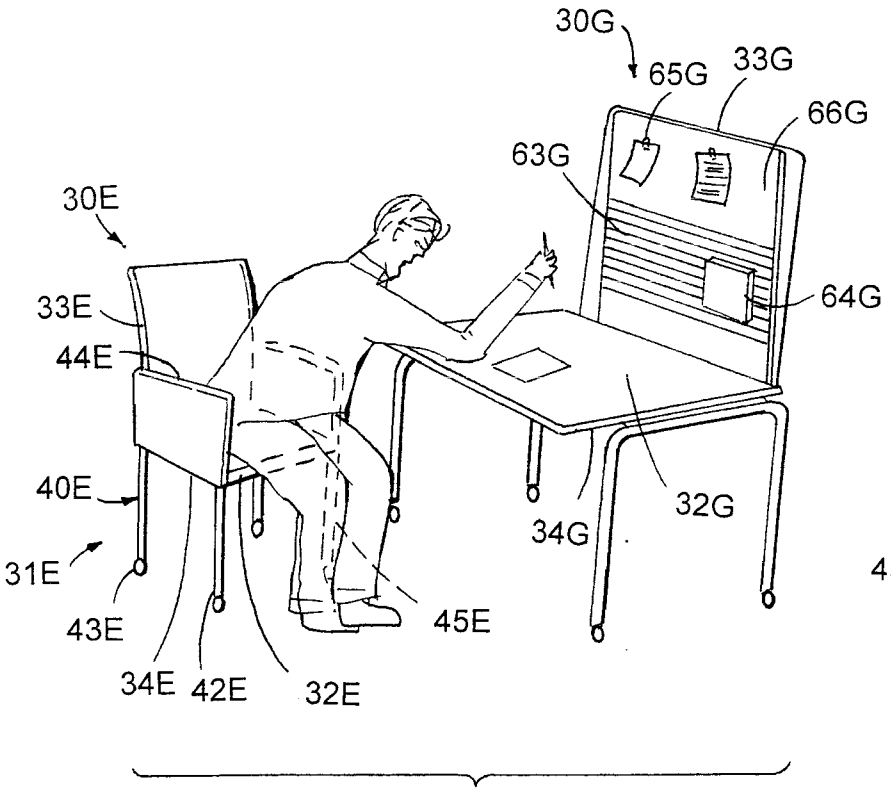

The FIGS. 15–16 show a chair-type furniture unit 30E as well as a desk-type furniture unit 30G that can be used together to provide an office area for an individual seated user, or that can be adjusted together to provide a conferencing area with a raised table for a multi-person conference and with a stool for the conference leader.

The chair-type furniture unit 30E (FIGS. 15–16) (also referred to herein as an adjustable seating unit) is most similar to the furniture unit 30B (FIGS. 3–10). The seating unit 30E (FIGS. 15–16) includes a base 31E with side frame sections 40E connected by at least one transverse member and the support 34E. The side frame sections 40E each have an inverted U-shape, and include front and rear legs 42E and 43E connected at their top ends by a rectangular armrest 44E. Castors 45E are attached to a bottom of each leg 42E and 43E. A latch arm (similar to the latch arm 50B, FIG. 10) is provided that is actuable from a front and center of the chair under the seat member 32E.

The furniture unit 30G (FIGS. 15 and 16) (also referred to herein as an adjustable desking unit) is most similar to the furniture unit 30A (FIG. 2). The base 31G includes inverted U-shaped side leg members 60G interconnected by one or more transverse frame members 61G. The supports 34G are pivoted to the transverse frame member 61G. The horizontal panel member 32G provides a flat worksurface in both of its adjusted positions. (See FIGS. 15–16.) The vertical panel member 33G is functional, and is movable between a raised access-permitting position (FIG. 15) and a lowered storage position (FIG. 16). For example, the vertical panel member 33G is useful as a visual screen to provide privacy to the worker when seated. The illustrated vertical panel member 33G also includes a functional front surface. For example, it is contemplated that the front surface can be adapted to provide support for accessories, such as by including grooves 63G (sometimes called "slat wall") designed to receive mating hooks and hanging fingers on accessories. One such accessory is illustrated, that being a paper holding pocket 64G. Such accessories are well known in the art, and a long list of the same is not necessary for an understanding of the present invention. The front surface may also include a tack board region 65G or an erasable/writable surface 66G for note-taking. When the vertical panel member 33G is moved to its lowered/storage position (FIG. 16), the working functional front surface is located below the horizontal panel member 32G and slightly inboard of the rear edge of the horizontal panel member 32G. This provides some level of security for materials on the working front surface of vertical panel member 33G, including at least some degree of visual privacy and also physical privacy. Also, by placing the vertical panel member 33G under and away from the rear edge of the horizontal panel member 32G, all four sides of the horizontal panel member 32G become available for use. Thus, as shown in FIG. 16, the workplace is transformed into a conferencing area, including a raised conference table that is available for use on all sides. When the seating unit 30E is adjusted to a stool position, the seating unit 30E can be conveniently used in a semi-standing rest position (see FIG. 16), or it can be slid totally under the horizontal panel member 32G (not specifically shown). When under the horizontal panel member 32G, the seating unit 30E provides a visual shield that obstructs viewing the front surface of the vertical panel member 33G, thus providing additional privacy. It is contemplated that the seating unit 30E or the desking unit 30G could include a lock for securing the seating unit 30E under the desking unit 30G, thus providing even more security for the functional panel 33G.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A furniture unit comprising:

a base;

a horizontal panel member having front and rear edges;

a vertical panel member having upper and lower edges; and a support with first, second, and third pivots spaced from each other, the first, pivot being connected to the base, the second pivot being connected to the horizontal panel proximate the front edge, and the third pivot being connected to the vertical panel member proximate the lower edge, the support being movable to a first position where a front surface of the vertical panel member is located generally rearward of and above the rear edge, and being movable to a second position where the vertical panel member is located generally rearward of and below the rear edge.

2. The furniture unit defined in claim 1, wherein the horizontal and vertical panel members form a seat and a back, respectively, of an adjustable chair when in the first position.

3. The furniture unit defined in claim 2, wherein the support, when in the first position, locates the seat at a lowered position, and when in the second position, locates the seat at a raised position.

4. The furniture unit defined in claim 3, including armrests supported on one of the base, the seat and the back.

5. The furniture unit defined in claim 1, wherein the top surface of the horizontal panel member is flat and defines a worksurface.

6. The furniture unit defined in claim 1, wherein the horizontal and vertical panel members combine to define a desk arrangement, with the horizontal panel member being a height-adjustable worksurface and with the vertical panel member being a height-adjustable-and-storable divider.

7. The furniture unit defined in claim 1, wherein the first, second, and third pivots are located on the support in a predetermined spaced arrangement that counterbalances the vertical panel member with the horizontal panel member to facilitate moving the support and the horizontal and vertical panel members between the first and second positions.

8. The furniture unit defined in claim 1, wherein the first pivot is located generally at a middle location on the base.

9. The furniture unit defined in claim 1, wherein the front surface of the vertical panel member includes a functional feature comprising one of an erasable surface, a grooved surface for supporting hanging accessories, and a tackable surface.

10. A furniture unit comprising:

a base;

a first panel member extending generally horizontally;

a second panel member extending generally vertically; and an adjustment mechanism operably connecting the first and second panel members to the base for movement between a first configuration where a substantial portion of said second panel member is above and generally behind the first panel member, and in a second configuration with a substantial portion of said second panel member being below the first panel member; said first panel member being positioned in a higher vertical location when in said second configuration than in said first configuration.

11. A furniture unit comprising:

a base; and an adjustable subassembly including first, second, and third structural members operably interconnected to each other in a serial arrangement and operably supported on the base for movement between a first position forming one of a low chair and a low desk, and a second position forming one of a stool and a high desk.

12. The furniture unit defined in claim 11, wherein the first and third structural members have a relatively flat shape.

13. The furniture unit defined in claim 12, wherein the first and third structural members form a back and seat of a chair.

14. The furniture unit defined in claim 12, wherein the first and third structural members form a worksurface and a rear screen of a desking unit.

15. A furniture unit comprising:

a base;

first and second panels supported on the base; and an adjustable support pivoted to the base and operably connected to the first and second panels, the adjustable support, when in a first position, locating a front surface of the second panel above and generally perpendicular to the first panel so that the second panel is usable and accessible while a person is simultaneously also using a top surface of the first panel, and when in a second position, locating the front surface of the second panel below a rear edge of the first panel so that the second panel is stored and the front surface is substantially not accessible over the top surface of the first panel.

16. A furniture unit comprising:

a desking unit including a worksurface having a rear edge;

a support operably connected to the desking unit; and a rear vertical panel also supported by the support for counterbalanced movement between a raised position where at least an upper portion of the vertical panel extends above the rear edge to act as a visual separator, and a lower position where the vertical panel extends below the rear edge to form a modesty panel.

17. The furniture unit defined in claim 16, wherein the vertical panel includes a functional front surface.

18. The furniture unit defined in claim 16, wherein the functional front surface includes an erasable surface.

19. The furniture unit defined in claim 16, wherein the functional front surface includes structure and non uniformity for supporting accessories thereon.

20. The furniture unit defined in claim 19, wherein the structure and non-uniformity include attachment grooves adapted to matingly receive attachment fingers on a hangable accessory.

21. The furniture unit defined in claim 16, wherein the support is pivoted to the base at a position that counterbalances a weight of the worksurface against a weight of the vertical panel during adjustment.

22. A furniture apparatus comprising:

a base;

a worksurface;

a functional panel; and a support adjustably supporting the worksurface and the functional panel on the base for movement between first positions and second positions;

when in the first position, the worksurface being positioned for use by a seated individual with the functional panel being located along and above a rear edge of the worksurface where the seated individual can reach across the worksurface and use the functional panel; and when in the second position, the worksurface being positioned for conferencing activity with several individuals located around all sides of the worksurface and with the functional panel being located below the worksurface so as to not interfere with the conferencing activity.

23. The furniture apparatus defined in claim 22, wherein the functional panel is located substantially under the worksurface when in the second position.

24. The furniture apparatus defined in claim 22, wherein the worksurface, when in the second position, is located at a height for use while people are standing around the worksurface.

25. An office furniture arrangement comprising, in combination:

an adjustable seating unit adjustable to a chair position for use as a chair, and adjustable to a stool position for use while substantially standing but while partially resting on the seating unit;

an adjustable desking unit including a vertically adjustable worksurface adapted to support papers at a desk height for use while sitting and at an elevated-table height for use while standing or resting on a stool;

the seating unit and the adjustable desking unit, when in the chair position and at the desk height, being usable as an individual's office, and when in the stool position and at the elevated-table height, being usable for conferencing with raised seating.

26. The office arrangement defined in claim 25, wherein the desking unit includes a base, a support pivoted to the base and to the worksurface, and a functional panel pivoted to the support, such that the worksurface and the functional panel are moved simultaneously when the support is pivoted.

27. The office arrangement defined in claim 25, wherein the chair includes a base, a support pivoted to the base, a seat pivoted to the support and a back also pivoted to the support.

* * * * *